US010191441B2

(12) United States Patent
Inoue

(10) Patent No.: US 10,191,441 B2
(45) Date of Patent: Jan. 29, 2019

(54) IMAGE FORMING APPARATUS

(71) Applicant: KYOCERA Document Solutions Inc., Osaka-shi, Osaka (JP)

(72) Inventor: Takashi Inoue, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/956,609

(22) Filed: Apr. 18, 2018

(65) Prior Publication Data

US 2018/0314201 A1 Nov. 1, 2018

(30) Foreign Application Priority Data

Apr. 27, 2017 (JP) ..... 2017-088053

(51) Int. Cl.
*G03G 21/10* (2006.01)

(52) U.S. Cl.
CPC ..... *G03G 21/10* (2013.01)

(58) Field of Classification Search
CPC .... G03G 21/10; G03G 21/12; G03G 15/0856; G03G 15/0858
See application file for complete search history.

(56) References Cited

U.S. PATENT DOCUMENTS

2016/0147176 A1* 5/2016 Tarui ..... G03G 21/12 399/35
2016/0378054 A1* 12/2016 Sato ..... G03G 15/0867 399/360

FOREIGN PATENT DOCUMENTS

JP 2006078586 A 3/2006

* cited by examiner

*Primary Examiner* — Sandra Brase
(74) *Attorney, Agent, or Firm* — Alleman Hall Creasman & Tuttle LLP

(57) ABSTRACT

In an image forming apparatus, a driving mechanism rotates a bottle attached to a bottle attaching portion by engaging with a first end of the bottle. A cover member, positioned to face a second end of the bottle, is supported to be able to open and close an opening from which the bottle is inserted. An elastic member applies upwards elastic force to the bottle attaching portion. A level sensor detects a position of the bottle attaching portion in an up-down direction. A signal processing device executes a full-state notifying process when a detection signal of the level sensor during operation of the driving mechanism fails to satisfy an abnormality condition, and the position indicated by the detection signal is lower than a predetermined reference position. The abnormality condition includes either or both of an amplitude condition and a cycle condition for a rotation cycle of the bottle.

6 Claims, 6 Drawing Sheets

IMAGE FORMING APPARATUS

INCORPORATION BY REFERENCE

This application is based upon and claims the benefit of priority from the corresponding Japanese Patent Application No. 2017-088053 filed on Apr. 27, 2017, the entire contents of which are incorporated herein by reference.

BACKGROUND

The present disclosure relates to an electrophotographic image forming apparatus.

In general, an electrophotographic image forming apparatus includes a bottle attaching portion to which a developer bottle is removably attached, wherein the developer bottle is configured to store powdery developer collected from an imaging portion. In this case, the used developer, referred to as "waste developer," is stored in the developer bottle.

The image forming apparatus includes a function that detects and notifies that the developer bottle has become full with the developer. A user can know by the notification that the developer bottle should be changed.

For example, there is known an image forming apparatus that includes a spring and a detecting sensor, wherein the spring is configured to support the weight of the bottle attaching portion to which the developer bottle is attached, and the detecting sensor is configured to detect that the bottle attaching portion has descended to a predetermined height. In this case, the image forming apparatus executes a full-state notifying process in response to a detection result of the detecting sensor.

In addition, the developer bottle may be attached to the bottle attaching portion in a state where a longitudinal direction of the developer bottle is horizontally oriented.

SUMMARY

An image forming apparatus according to an aspect of the present disclosure includes a bottle attaching portion, a driving mechanism, a cover member, an elastic member, a level sensor, and a signal processing device. The bottle attaching portion is supported to be movable in an up-down direction, and a bottle that stores powdery developer is removably attached in a state where a longitudinal direction of the bottle is horizontally oriented. The driving mechanism rotates the bottle attached to the bottle attaching portion by engaging with a first end of the bottle in the longitudinal direction. The cover member is supported in such a way as to be able to open and close an opening of a body of the image forming apparatus from which the bottle is inserted, the cover member being positioned facing a second end of the bottle in the longitudinal direction attached to the bottle attaching portion. The elastic member is configured to apply upwards elastic force to the bottle attaching portion. The level sensor is configured to detect a position of the bottle attaching portion in the up-down direction. The signal processing device is configured to execute an abnormality notifying process when a detection signal of the level sensor during operation of the driving mechanism satisfies an abnormality condition that includes either or both of a predetermined amplitude condition or a cycle condition for a rotation cycle of the bottle. Furthermore, the signal processing device is configured to execute a full-state notifying process when the detection signal during operation of the driving mechanism fails to satisfy the abnormality condition, and the position indicated by the detection signal is lower than a predetermined reference position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
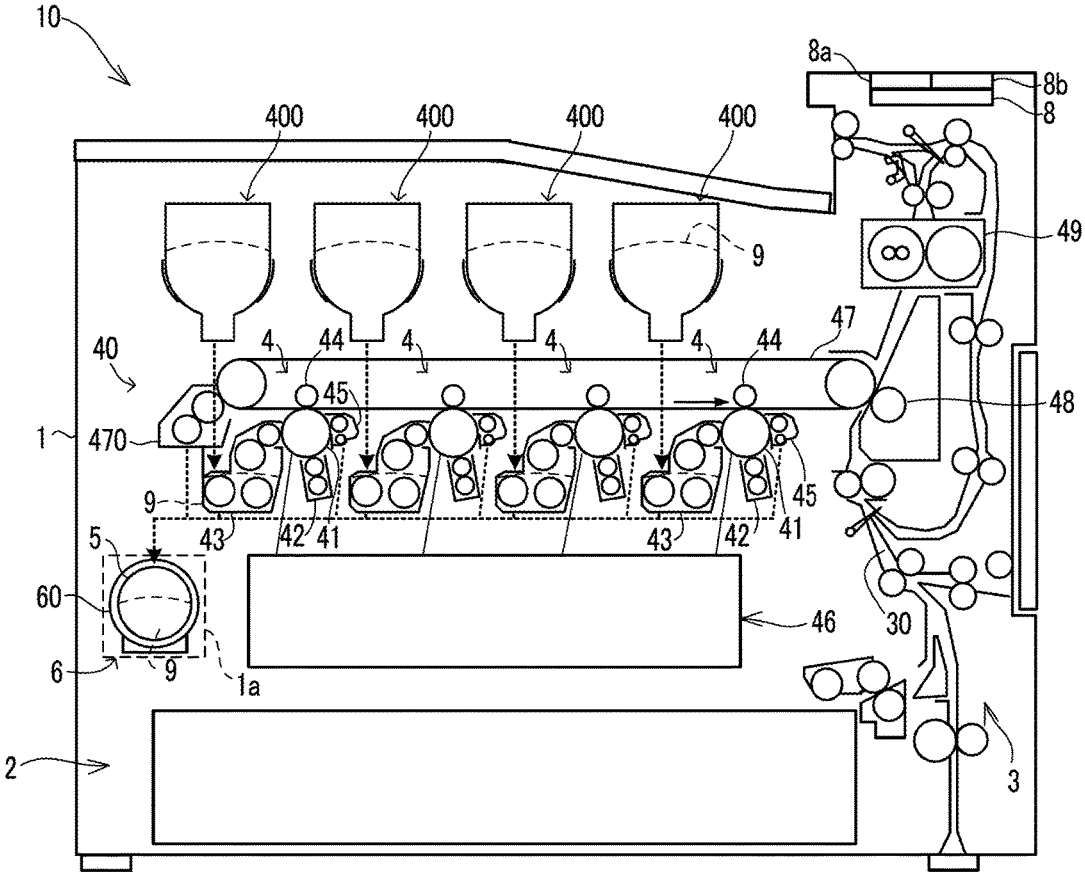
FIG. 1 is a configuration diagram of an image forming apparatus according to an embodiment.

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment of the present disclosure is configured to form an image on a sheet by an electrophotographic system. The sheet is a sheet-like image forming medium such as a sheet of paper or resin film.

The image forming apparatus 10 includes, within a body 1, a sheet supplying mechanism 2, a sheet conveying mechanism 3, a print processing device 40, an optical scanning unit 46, a fixing device 49, a plurality of developer replenishing units 400, and a developer collecting portion 6.

The print processing device 40 uses a powdery developer 9 to execute a print process for forming an image on a sheet. The print processing device 40 includes a plurality of imaging devices 4 and other devices relating to image-developing and to conveying the developer 9. The developer 9 at least includes toner.

Each of the imaging devices 4 includes a photoconductor 41, a charging device 42, a developing device 43, a primary transfer device 44, and a primary cleaning device 45.

The image forming apparatus 10 shown in FIG. 1 is a tandem-type image forming apparatus and a color printer. Accordingly, the print processing device 40 includes the plurality of the imaging devices 4 that correspond to a plurality of colors of the developer 9, an intermediate transfer belt 47, a secondary transfer device 48, and a secondary cleaning device 470. In addition, the developer replenishing units 400 also are provided in correspondence to the colors of the developer 9.

The sheet supplying mechanism 2 delivers the sheet on which the image is formed to a sheet conveyance path 30, and the sheet conveying mechanism 3 conveys the sheet along the sheet conveyance path 30. The intermediate transfer belt 47 is an endless belt-like member that rotates while in a bridged state between two rollers.

In each of the imaging devices 4, the drum-shaped photoconductor 41 rotates, and the charging device 42 uniformly charges a surface of the photoconductor 41. The optical scanning unit 46 writes an electrostatic latent image on the surface of the photoconductor 41 by scanning with a laser light.

The developing device 43 develops the electrostatic latent image as an image of the developer 9 by supplying the developer 9 to the surface of the photoconductor 41. For example, the developing device 43 may execute processing for developing by using a two-component developer that includes the toner and a carrier. In this case, the carrier is preliminarily stored in the developing device 43, and unused developer 9 is supplied from the developer replenishing unit 400 to the developing device 43. The carrier is a magnetic granular material.

The primary transfer device 44 transfers the image of the developer 9 from the surface of the imaging device 4 to the intermediate transfer belt 47. With this configuration, a color image is formed on the intermediate transfer belt 47 by overlaying the images of the developer 9 in the plurality of different colors on top of each other. The primary cleaning device 45 removes the developer 9 remaining on the surface of the photoconductor 41.

The secondary transfer device 48 transfers the color image from the intermediate transfer belt 47 to the sheet. The secondary cleaning device 470 removes the developer 9 remaining on the intermediate transfer belt 47. The fixing device 49 uses heat to fix the color image on the sheet.

The developer 9 is removed from the photoconductors 41 by the primary cleaning devices 45 and from the intermediate transfer belt 47 by the secondary cleaning device 470, and the removed developer 9 is conveyed to the developer collecting portion 6. In the developer collecting portion 6, the developer 9 is stored in a developer bottle 5. The developer bottle 5 is removably attached to a bottle attaching portion 60 of the developer collecting portion 6.

It is noted that in a case where the developer 9 inside the developing device 43 is the two-component developer, a portion of the carrier that has deteriorated inside the developing device 43 is also conveyed to the developer collecting portion 6 and stored in the developer bottle 5. The used developer 9 collected in the developer bottle 5 is so-called "waste developer".

Furthermore, the image forming apparatus 10 includes a controler 8, an operation device 8*a*, and a display device 8*b*. The operation device 8*a* may be a touch panel or operation buttons for receiving human operations. The display device 8*b* may be a liquid crystal panel unit for displaying information.

Figure 2:
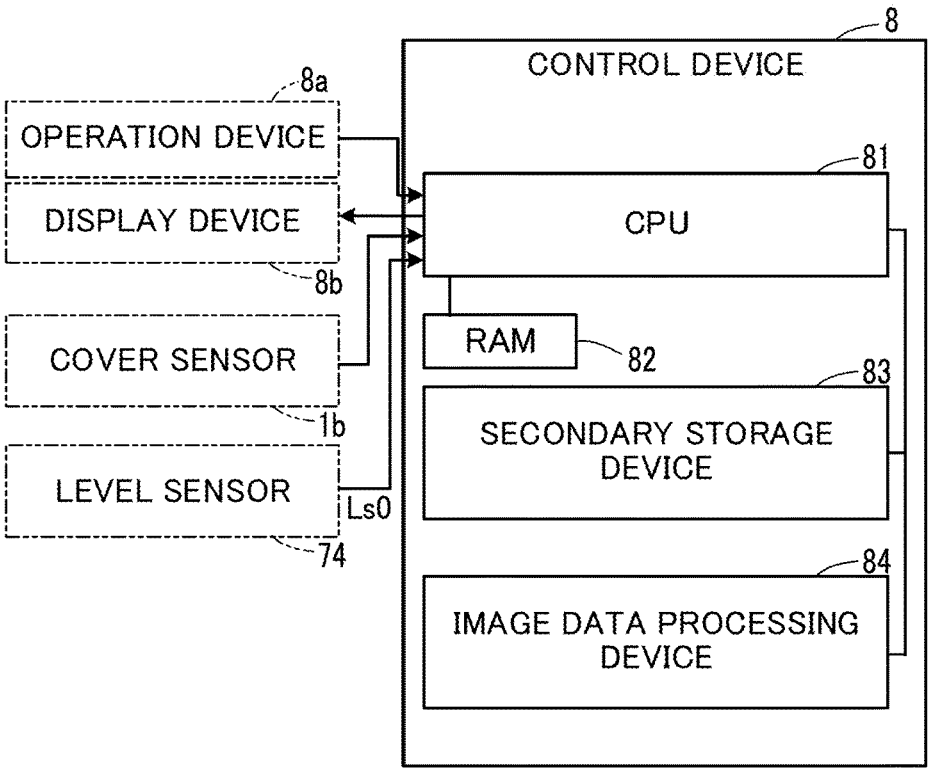
FIG. 2 is a block diagram of a controller included in the image forming apparatus according to an embodiment.

As shown in FIG. 2, the controler 8 includes a CPU (Central Processing Unit) 81, a RAM (Random Access Memory) 82, a secondary storage device 83, and an image data processing device 84. The CPU 81 controls electric devices in the image forming apparatus 10 and executes various types of data processing by executing programs stored in the secondary storage device 83.

It is noted that another processor, such as a DSP (Digital Signal Processor), may execute the various types of control and data processing instead of the CPU 81.

The RAM 82 is a storage device configured to primarily store the programs executed by the CPU 81, and data that is outputted and referred to by the CPU 81 during the process of executing the programs.

The secondary storage device 83 is a device configured to store computer-readable non-volatile data. The secondary storage device 83 is able to store the program and various types of data. For example, either or both of a hard disk drive and an SSD (Solid State Drive) are employed as the secondary storage device 83.

The image data processing device 84 executes image processing such as image data processing and conversion processing of image data used in the print processing. For example, the image data processing device 84 may execute a process such as transforming print job data to raster data for printing.

The image data processing device 84 is realized by either or both of a processor such as the DSP and an integrated circuit such as an ASIC (Application Specific Integrated Circuit).

[Developer Bottle 5]

Figure 3:
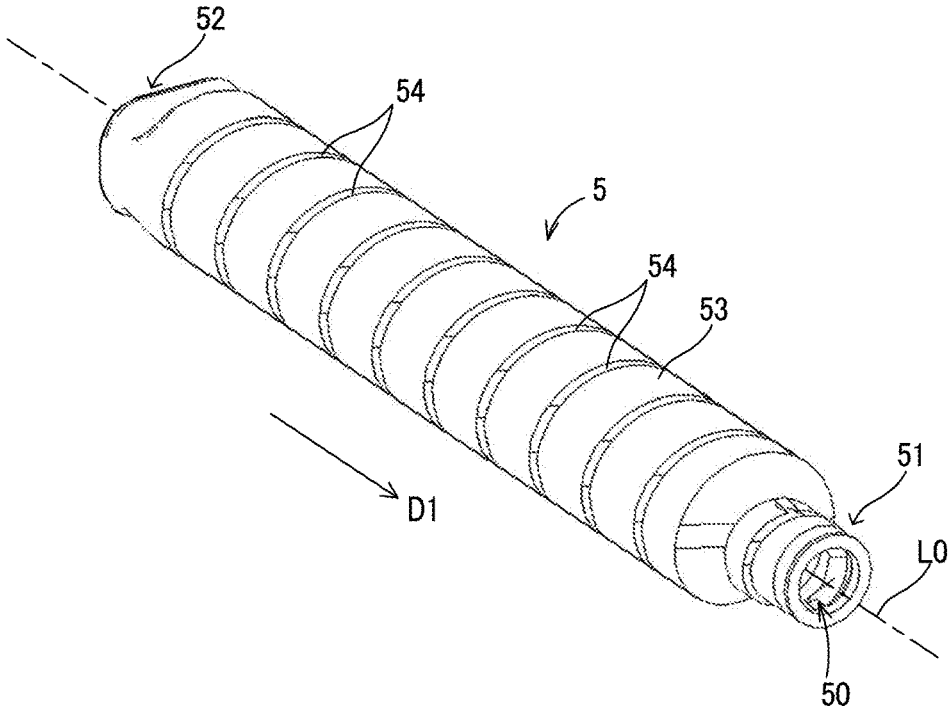
FIG. 3 is a perspective diagram of a developer bottle included in the image forming apparatus according to an embodiment.

As shown in FIG. 3, the developer bottle 5 is a hollow member with an opening 50 formed at a first end 51, one of opposite ends thereof, wherein the developer 9 is collected in the developer bottle from the opening 50. The developer bottle 5 is a member whose longitudinal direction is from the first end 51 to a second end 52 that is opposite to the first end 51. The developer bottle 5 has an outer peripheral surface 53 that is cylindrical. A straight line along the longitudinal direction of the developer bottle 5 is a centerline L0 of the outer peripheral surface 53.

Figure 5:
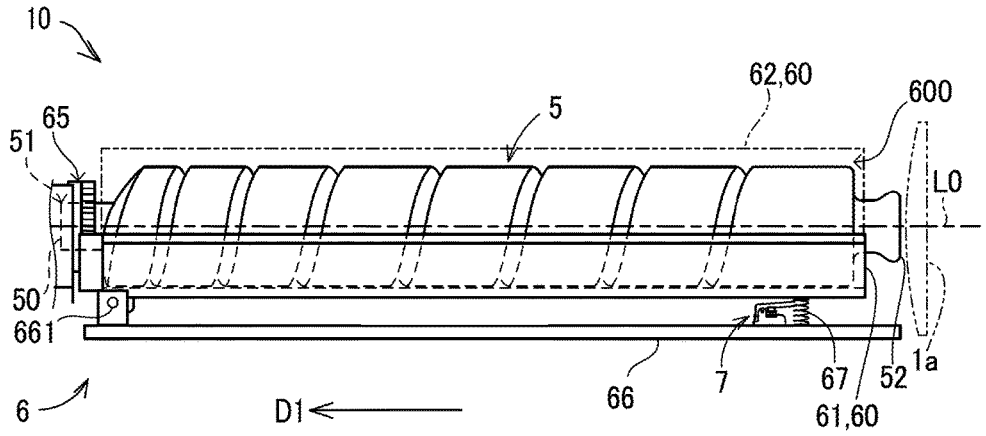
FIG. 5 is a configuration diagram of the developer collecting portion of the image forming apparatus according to an embodiment.
Figure 6:
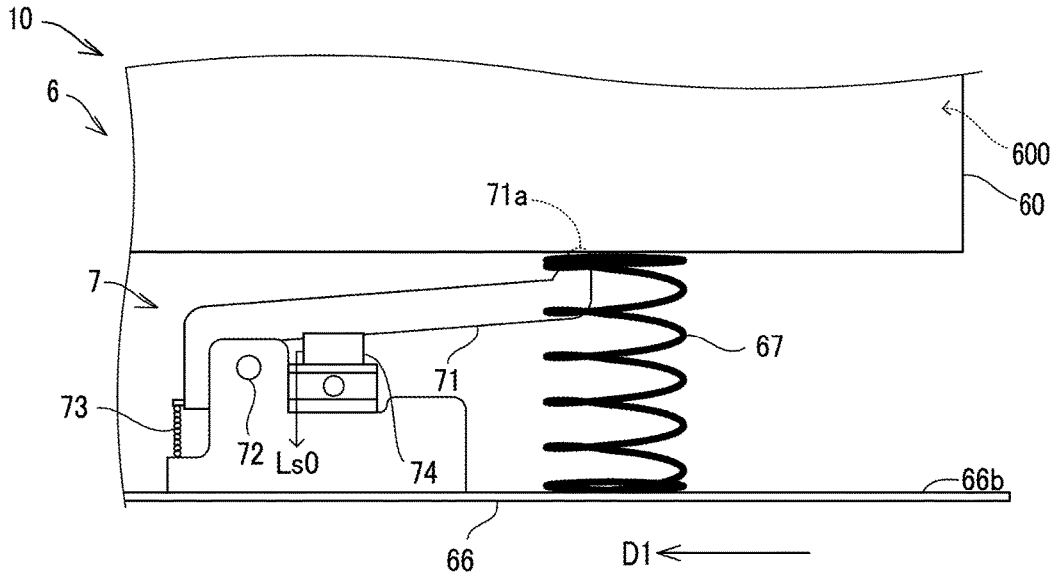
FIG. 6 is a configuration diagram of a level sensor and its peripheral portions in the developer collecting portion of the image forming apparatus according to an embodiment.
Figure 7:
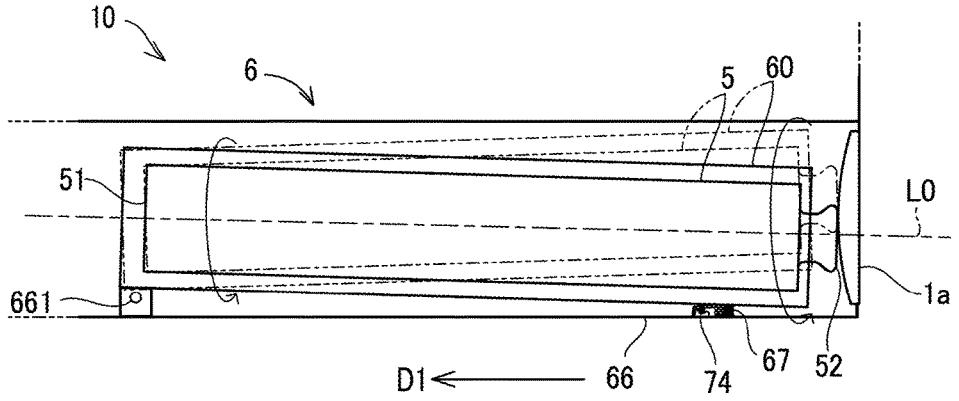
FIG. 7 is a diagram schematically showing the developer bottle rotating abnormally in the image forming apparatus according to an embodiment.

The developer bottle 5 is attached to the bottle attaching portion 60 in a state where the longitudinal direction of the developer bottle 5 is horizontally oriented. The developer bottle 5 is inserted in the bottle attaching portion 60 starting from the first end 51. Hereinafter, a direction in which the developer bottle 5 is inserted in the bottle attaching portion 60 is referred to as "insertion direction D1". In FIG. 5 to FIG. 7, the insertion direction D1 is leftward.

Meanwhile, in a case where the developer bottle 5 is attached to the bottle attaching portion 60 in a state where the longitudinal direction of the developer bottle 5 is horizontally oriented, the developer 9 is prone to accumulate inside the developer bottle 5 in a deviated manner along the longitudinal direction thereof.

When the developer 9 accumulates in a deviated manner inside the developer bottle 5, there is a possibility that the developer 9 may overflow from the opening 50 of the developer bottle 5 before a full-state of the developer bottle 5 is detected. Accordingly, a mechanism for leveling the accumulation of the developer 9 inside the developer bottle 5 is required.

On the other hand, it is also necessary to prevent the full-state of the developer bottle 5 from being detected incorrectly when there is a large space in the developer bottle 5.

The developer collecting portion 6 in the image forming apparatus 10 uses a simple mechanism to detect the full-state of the developer bottle 5 correctly and level the accumulation of the developer 9 in the developer bottle 5. In the following, the developer collecting portion 6 is described.

[Developer Collecting Portion 6]

Figure 4:
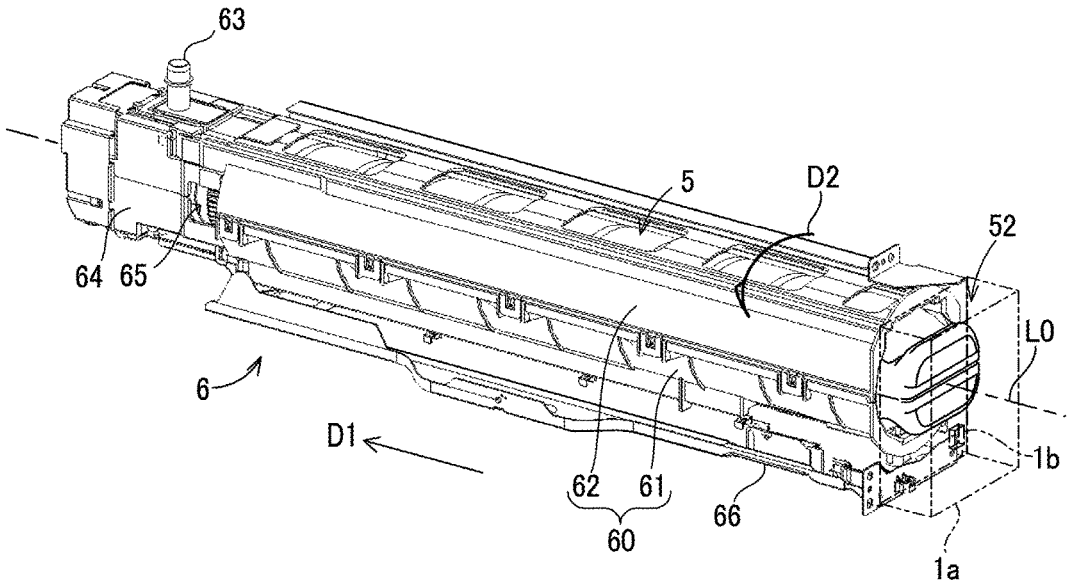
FIG. 4 is a perspective diagram of a developer collecting portion of the image forming apparatus according to an embodiment.

As shown in FIG. 4 and FIG. 5, the developer collecting portion 6 includes the bottle attaching portion 60, a receiving duct 63, a conveyance relay member 64, a drive mechanism 65, a support frame 66, a spring 67, and a displacement sensing device 7. The bottle attaching portion 60 includes a bottle receiving portion 61 combined with a bottle cover 62.

For example, the bottle receiving portion 61 may be a metal member and the bottle cover 62 may be a member made of synthetic resin. It is noted that in FIG. 5, the bottle cover 62 is shown by an imaginary line (a two-dot chain line).

The bottle receiving portion 61 supports the outer peripheral surface 53 of the developer bottle 5 from below, and the bottle cover 62 covers the developer bottle 5 from above. The bottle attaching portion 60 contains an attaching space 600 inside thereof along the insertion direction D1. The developer bottle 5 is inserted in the attaching space 600.

The developer bottle 5 is attached to the bottle attaching portion 60 by being inserted, starting from the first end 51, from an entrance of the bottle attaching portion 60 in the insertion direction D1. In addition, the developer bottle 5 is removed from the bottle attaching portion 60 by being pulled out from the attaching space 600 in an opposite direction of the insertion direction D1.

A cover member 1*a* is an exterior portion of the body 1 and is supported in such a way as to be able to open and close an opening of the body 1 from which the developer bottle 5 is inserted. In FIG. 4 and FIG. 5, the cover member 1*a* is shown by an imaginary line.

The cover member 1*a* is positioned to face the second end 52 of the developer bottle 5 attached to the bottle attaching portion 60. The cover member 1*a* is supported in such a way as to be able to open and close an opening of the body 1 from which the developer bottle 5 is inserted.

The image forming apparatus 10 further includes a cover sensor 1*b* that detects whether or not the cover member 1*a* is closed (refer to FIG. 2 and FIG. 4). The CPU 81 is able to detect that the cover member 1*a* has been opened or closed by detecting a change in a detection signal of the cover sensor 1*b*.

The receiving duct 63 receives the developer 9 that falls from a developer conveying mechanism (not shown). The receiving duct 63 is formed in a vertical direction. The developer conveying mechanism conveys the developer 9 from the primary cleaning devices 45, the secondary cleaning device 470, and the developing devices 43 to above the receiving duct 63.

The conveyance relay member 64 contains a relay conveyance path (not shown) inside thereof. The developer 9 is conveyed along the relay conveyance path from the receiving duct 63 to the opening 50 of the developer bottle 5. The developer 9 is conveyed into the opening 50 of the developer bottle 5 via the receiving duct 63 and the relay conveyance path inside the conveyance relay member 64.

The drive mechanism 65 rotates the developer bottle 5 by engaging with the first end 51 of the developer bottle 5 attached to the bottle attaching portion 60. The drive mechanism 65 includes a motor (not shown) and a gear (not shown), wherein the gear transmits the rotational force of the motor to the first end 51 of the developer bottle 5. The developer bottle 5 receives motive power from the drive mechanism 65 and rotates around the centerline L0 in a predetermined rotational direction D2.

When the developer bottle 5 rotates in the predetermined rotational direction D2, the developer 9 inside the developer bottle 5 is leveled along the longitudinal direction. That is, the drive mechanism 65 levels the accumulation of the developer 9 inside the developer bottle 5. The action of the drive mechanism 65 prevents the developer 9 from accumulating in the developer bottle 5 in a state of being deviated toward the opening 50.

As shown in FIG. 3, the developer bottle 5 includes a plurality of spiral projecting portions 54 that are formed in a spiral shape around the centerline L0 along the longitudinal direction of the developer bottle 5. The spiral projecting portions 54 spirally project inward the developer bottle 5. It is noted that the spiral projecting portions 54, when viewed from outside of the developer bottle 5, are spirally recessed.

When the developer bottle 5 is rotating in the predetermined rotational direction D2, the spiral projecting portions 54 convey the developer 9 inside the developer bottle 5 in an opposite direction of the insertion direction D1. As a result, the developer 9 is effectively leveled along the longitudinal direction of the developer bottle 5.

The bottle attaching portion 60 is supported by the support frame 66 in the body 1 such that the bottle attaching portion 60 is movable in an up-down direction. Specifically, a support shaft 661 in the support frame 66 supports the bottle attaching portion 60 such that the bottle attaching portion 60 is pivotable in the up-down direction at a downstream portion of the bottle attaching portion 60 in the insertion direction D1.

Furthermore, the spring 67 applies an upward elastic force to the bottle attaching portion 60 in the developer collecting portion 6. The spring 67 applies the elastic force at an upstream portion of the bottle attaching portion 60 in the insertion direction D1.

As an amount of the developer 9 inside the developer bottle 5 increases, the developer collecting portion 6 to which the developer bottle 5 is attached is downwardly displaced against the elastic force of the spring 67.

As shown in FIG. 6, the displacement sensing device 7 includes a pivoting member 71, a support shaft 72, a spring 73, and a level sensor 74. Hereinafter, the spring 67 that acts on the bottle attaching portion 60 is referred to as "first spring 67", and the spring 73 of the displacement sensing device 7 is referred to as "second spring 73".

It is noted that the first spring 67 and the second spring 73 shown in FIG. 6 are coil springs. The first spring 67 and the second spring 73 may be springs of a different type or may be rubber. It is further noted that the first spring 67 and the second spring 73 are each an example of an elastic member.

The pivoting member 71 is supported by the support shaft 72 so as to be pivotable in an up-down direction. The second spring 73 keeps a tip portion 71a of the pivoting member 71 in contact with a bottom surface of the bottle attaching portion 60. When the bottle attaching portion 60 is displaced in the up-down direction, the pivoting member 71 moves in conjunction with the displacement.

The level sensor 74 detects a position of the pivoting member 71 in the up-down direction. For example, the level sensor 74 may be a transmissive photosensor that includes a light emitting element and a light receiving element disposed on opposite sides of the pivoting member 71.

In a case that the level sensor 74 is the transmissive photosensor, the pivoting member 71 blocks light going from the light emitting element to the light receiving element. In addition, the amount of light blocked by the pivoting member 71 changes in response to a position of bottle attaching portion 60 in the up-down direction. Accordingly, a level of a detection signal Ls0 of the level sensor 74 changes in response to the position of the bottle attaching portion 60 in the up-down direction.

That is, the level sensor 74 detects the position of the bottle attaching portion 60 in the up-down direction via the pivoting member 71. The level sensor 74, by detecting the position of the bottle attaching portion 60, indirectly detects the amount of the developer 9 inside the developer bottle 5. The lower the position indicated by the detection signal Ls0 of the level sensor 74 is, there is a greater amount of the developer 9 inside the developer bottle 5.

It is noted that the level sensor 74 may be a reflection type photosensor, an LED type displacement sensor, a contact type displacement sensor, or the like.

The CPU 81 of the controler 8 executes a full-state notifying process when the position indicated by the detection signal Ls0 of the level sensor 74 is lower than a predetermined reference position. For example, in the full-state notifying process, information is displayed on the display device 8*b* notifying either or both of the following: that the developer bottle 5 is full; and that the developer bottle 5 needs to be replaced.

In the image forming apparatus 10, when the developer bottle 5 is not fully attached to the bottle attaching portion 60, the second end 52 of the developer bottle 5 may get caught on the closed cover member 1*a*.

In a case that the developer bottle 5 is correctly attached to the bottle attaching portion 60, the developer bottle 5 rotates centered on the centerline LO when the developer bottle 5 is driven by the drive mechanism 65.

On the other hand, as shown in FIG. 7, the developer bottle 5 may be driven by the drive mechanism 65 while the second end 52 of the developer bottle 5 is caught on the cover member 1*a*. In this case, the developer bottle 5 abnormally rotates while the second end 52 turns.

Accordingly, when the second end 52 of the developer bottle 5 is caught on the cover member 1*a*, the detection signal Ls0 of the level sensor 74 incorrectly shows the amount of the developer 9 inside the developer bottle 5.

Accordingly, the CPU 81 executes a process that detects the abnormal rotation of the developer bottle 5 when executing a full-state detecting process described below. The CPU 81 is an example of a signal processing device that executes the full-state detecting process and other processes based on the detection signal Ls0 of the level sensor 74, the detection signal of the cover sensor 1*b*, or the like.

[Full-State Detecting Process]

Figure 8:
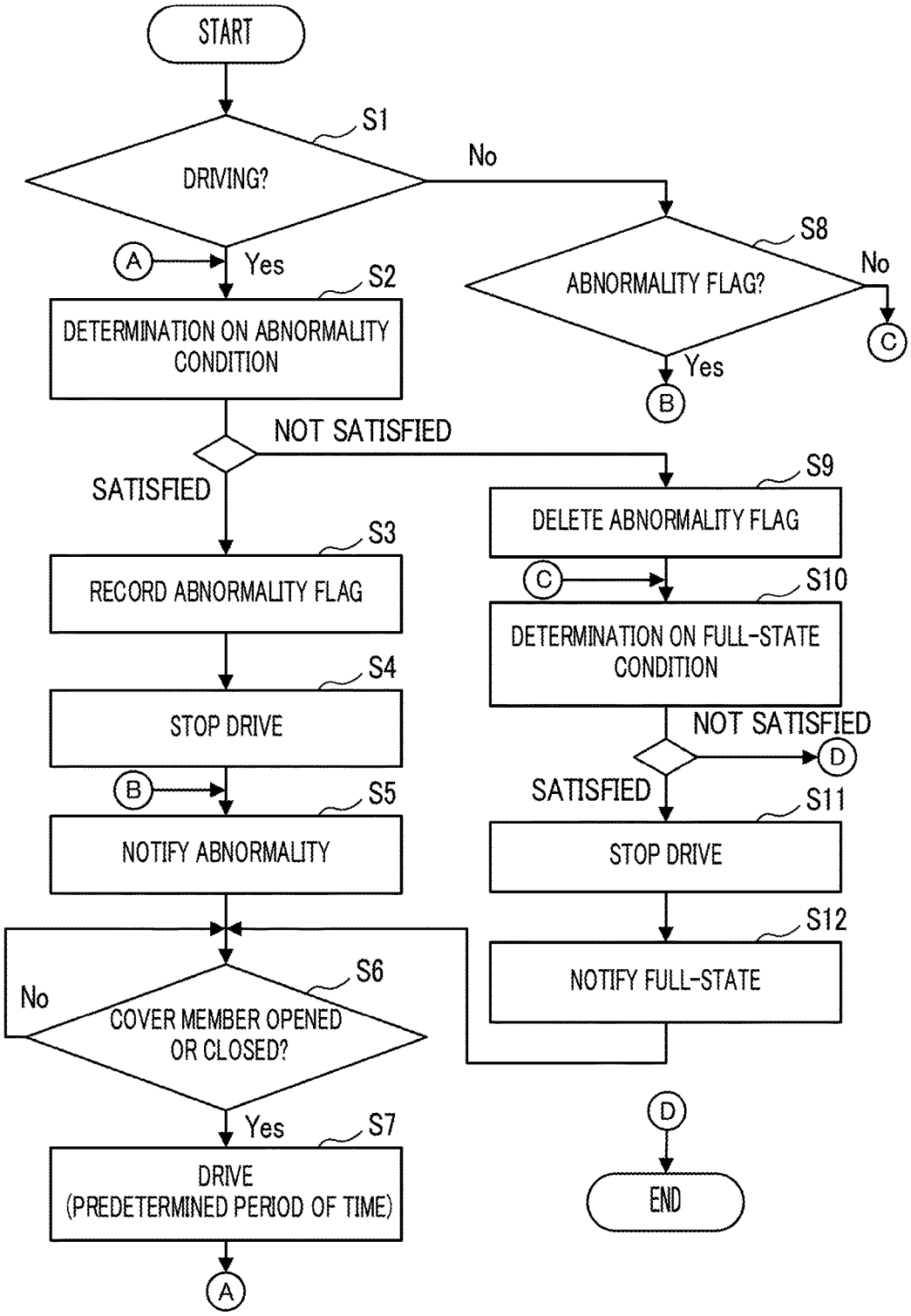
FIG. 8 is a flowchart showing an example of a procedure for a full-state notifying process of the image forming apparatus according to an embodiment.

In the following, an example procedure of the full-state detecting process is described with reference to the flowchart shown in FIG. 8.

The CPU 81 executes the full-state detecting process when a predetermined full-state inspecting event is detected. For example, the full-state inspecting event is that the image forming apparatus 10 has been activated, that the print process of a predetermined number of pages has been executed, or the like.

In the following description, S1, S2, . . . are identification signs representing the steps in the full-state detecting process.

<Step S1>

In the full-state detection process, when the drive mechanism 65 is rotationally driving the developer bottle 5, the CPU 81 moves the process to step S2, and otherwise, moves the process to step S8.

<Step S2>

In step S2, the CPU 81 determines whether or not the detection signal Ls0 of the level sensor 74 satisfies a predetermined abnormality condition. The abnormality condition is established when the developer bottle 5 rotates abnormally.

The abnormality condition includes either or both of a predetermined amplitude condition and a cycle condition for a rotation cycle of the developer bottle 5 in the detection signal Ls0 while the drive mechanism 65 is in operation. A specific example of the abnormality condition is described below.

When the CPU 81 determines that the detection signal Ls0 satisfies the abnormality condition, the CPU 81 moves the process to steps S3 to S5, and otherwise, moves the process to step S9.

<Step S3 to step S5>

When the detection signal Ls0 satisfies the abnormality condition, the CPU 81 records an abnormality flag to the secondary storage device 83, the abnormality flag showing that the abnormality condition has been established (S3). Furthermore, the CPU 81 stops the drive mechanism 65 (S4). Furthermore, the CPU 81 executes an abnormality notifying process (S5). Thereafter, the CPU 81 moves the process to step S6.

For example, in the abnormality notifying process, information is displayed on the display device 8*b*, the information notifying either or both of the following: that the developer bottle 5 is attached defectively; and that the developer bottle 5 needs to be reattached.

<Step S6>

In step S6, the CPU 81 monitors changes in the detection signal of the cover sensor 1*b* and waits until the cover member 1*a* is opened or closed. The CPU 81 moves the process to step S7 when the CPU 81 detects that the cover member 1*a* has been opened or closed.

<Step S7>

In step S7, the CPU 81 operates the drive mechanism 65 for a predetermined amount of time. The CPU 81 then re-executes the process from step S2 based on the detection signal Ls0 when the drive mechanism 65 is operating.

<Step S8>

In a case where it has been judged in step S1 that the drive mechanism 65 is not operating, the CPU 81 determines whether or not the abnormality flag has been recorded in the secondary storage device 83. When the CPU 81 determines that the abnormality flag has been recorded in the secondary storage device 83, the CPU 81 moves the process to step S5, and otherwise, the CPU 81 moves the process to step S10.

<Step S9>

When it is determined in step S2 that the detection signal Ls0 fails to satisfy the abnormality condition, the CPU 81 deletes the abnormality flag from the secondary storage device 83. Thereafter, the CPU 81 moves the process to step S10.

When the abnormality flag does not exist in the secondary storage device 83, the CPU 81 skips step S9 and moves the process to step S10.

<Step S10>

In step S10, the CPU 81 determines whether or not the detection signal Ls0 satisfies a predetermined full-state condition. The predetermined full-state condition is that the detection signal Ls0 is lower than the predetermined reference position.

When the CPU 81 determines that the detection signal Ls0 satisfies the full-state condition, the CPU 81 moves the process to step 11 and step 12, and otherwise, ends the full-state detecting process.

<Step 11 and Step 12>

When the detection signal Ls0 satisfies the full-state condition, the CPU 81 stops the drive mechanism 65 (S11), and furthermore, executes the full-state notifying process (S12). Thereafter, the CPU 81 moves the process to step S6. This allows for the process from step S6 to be repeated until the detection signal Ls0 satisfies neither the abnormality condition nor the full-state condition.

Figure 9:
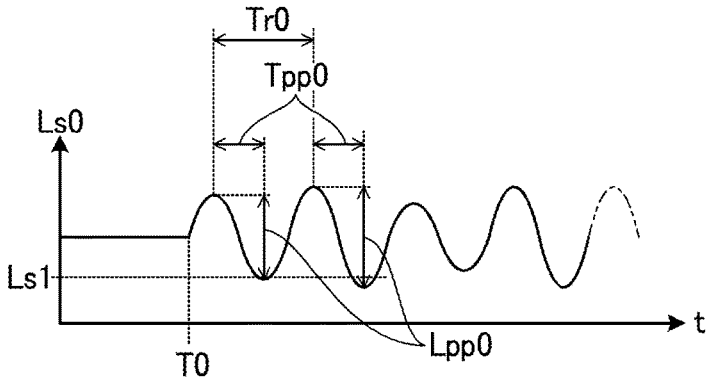
FIG. 9 is a graph showing a change in a level detecting signal when the developer bottle rotates abnormally in the image forming apparatus according to an embodiment.

As shown in FIG. 9, when the developer bottle 5 rotates abnormally, the level of the detection signal Ls0 fluctuates in synchronization with a rotation cycle Tr0 of the developer bottle 5. In FIG. 9, the level of the detection signal Ls0 is fluctuating from an operation start point T0 of the drive mechanism 65. The rotation cycle Tr0 is known, since the drive mechanism 65 rotates the developer bottle 5 at a predetermined speed.

[First Example of Determining Abnormality Condition]

The following describes a first example of a process in which the CPU 81 determines whether or not the abnormality condition is satisfied. In the first example, the cycle condition is a frequency condition that a result of a Fourier transform process performed on the detection signal Ls0 includes a predetermined degree of frequency component that corresponds to the rotation cycle Tr0.

In the following, the frequency component of the rotation cycle Tr0 is referred to as "rotation frequency component". The rotation frequency component is a predetermined frequency band that includes a reference frequency that is a reciprocal of the rotation cycle Tr0.

When the CPU 81 executes a known fast Fourier transform process for the detection signal Ls0, the energy is calculated for each of a plurality of frequency components including the rotation frequency component. The CPU 81 determines that the frequency condition has been satisfied when the energy of the rotation frequency component is larger than a predetermined threshold.

When the detection signal Ls0 satisfies the frequency condition, the CPU 81 determines that the detection signal Ls0 satisfies the abnormality condition.

In addition, the amplitude condition may include a first peak value condition and a second peak value condition described below (refer to FIG. 9). The first peak value condition is that a peak-to-peak value Lpp0 of the detection signal Ls0 is higher than a predetermined upper limit value. The second peak value condition is that the peak-to-peak value Lpp0 of the detection signal Ls0 is higher than a predetermined reference value and lower than the upper limit value, wherein the reference value is lower than the upper limit value.

It is noted that the upper limit value and the reference value are each an example of a predetermined threshold for the peak-to-peak value Lpp0.

The detection signal Ls0 fluctuates from vibrations of the developer bottle 5 at a sufficiently smaller cycle than the rotation cycle Tr0. Accordingly, the peak-to-peak value Lpp0 of the detection signal Ls0 may be derived by detecting an inflection point of a signal value after the CPU 81 performs a low pass filtering process on the detection signal Ls0.

For example, when the detection signal Ls0 satisfies the first peak value condition, the CPU 81 does not execute the Fourier transform process and determines that the detection signal Ls0 satisfies the abnormality condition. In this case, when the detection signal Ls0 satisfies the second peak value condition and the frequency condition, the CPU 81 determines that the detection signal Ls0 satisfies the abnormality condition.

When the detection signal Ls0 fails to satisfy the second peak value condition, the CPU 81 does not execute the Fourier transform process and determines that the detection signal Ls0 fails to satisfy the abnormality condition.

In a situation where the first peak value condition is satisfied, the developer bottle 5 is rotating abnormally, and a fluctuation cycle of the detection signal Ls0, that is, a fluctuation frequency of the detection signal Ls0, does not need to be confirmed. On the other hand, in a situation where neither the first peak value condition nor the second peak value condition is satisfied, the developer bottle 5 is rotating correctly, and the fluctuation cycle of the detection signal Ls0 does not need to be confirmed.

In general, the Fourier transform process is a large computing load for the CPU 81. In the first example, the CPU 81 executes the Fourier transform process only when a determining process with a small computing load cannot determine whether or not the developer bottle 5 is rotating abnormally. With this configuration, it is possible to minimize computing load for the CPU 81.

[Second Example of Determining Abnormality Condition]

The following describes a second example of a process in which the CPU 81 determines whether or not the abnormality condition is satisfied. In the second example, the amplitude condition includes the first peak value condition and the second peak value condition.

In addition, in the second example, the cycle condition includes the frequency condition and a peak interval condition. The peak interval condition is that a peak-to-peak time interval Tpp0 is within a predetermined error range of a half cycle of the rotation of the developer bottle 5. The half cycle is half of the rotation cycle Tr0.

In the second example, when the detection signal Ls0 satisfies the first peak value condition and the peak interval condition, the CPU 81 does not execute the Fourier transform process and determines that the detection signal Ls0 satisfies the abnormality condition.

Furthermore, when the detection signal Ls0 satisfies the second peak value condition and the frequency condition, the CPU 81 determines that the detection signal Ls0 satisfies the abnormality condition.

When the detection signal Ls0 fails to satisfy the second peak value condition, the CPU 81 does not execute the Fourier transform process and determines that the detection signal Ls0 fails to satisfy the abnormality condition.

In the second example, a requirement for satisfying the abnormality condition is to satisfy both the first peak value condition and the peak interval condition. With this configuration, the upper limit value of the first peak value condition can be set at a closer value to the reference value while avoiding a misdetection of abnormal rotation of the developer bottle 5.

Accordingly, according to the second example, a frequency at which the Fourier transform process is executed can be further reduced.

[Third Example of Determining Abnormality Condition]

The following describes a third example of a process in which the CPU 81 determines whether or not the abnormality condition is satisfied. In the third example, the amplitude condition is the second peak value condition, and the cycle condition is the peak interval condition.

In the third example, when the detection signal Ls0 satisfies both the second peak value condition and the peak interval condition, the CPU 81 determines that the detection signal Ls0 satisfies the abnormality condition.

When the detection signal Ls0 fails to satisfy at least one of the second peak value condition and the peak interval condition, the CPU 81 determines that the detection signal Ls0 fails to satisfy the abnormality condition.

In the third example, the CPU 81 does not execute the Fourier transform process. This allows for easier determination of whether or not the abnormality condition is satisfied.

[Fourth Example of Determining Abnormality Condition]

The following describes a fourth example of a process in which the CPU 81 determines whether or not the abnormality condition is satisfied. In the fourth example, the amplitude condition is the first peak value condition, and the cycle condition is not employed.

In the fourth example, when the detection signal Ls0 satisfies the first peak value condition, the CPU 81 determines that the detection signal Ls0 satisfies the abnormality condition.

When the detection signal Ls0 fails to satisfy the first peak value condition, the CPU 81 determines that the detection signal Ls0 fails to satisfy the abnormality condition.

In the fourth example, the CPU 81 does not execute the Fourier transform process. This allows for easier determination of whether or not the abnormality condition is satisfied.

[Fifth Example of Determining Abnormality Condition]

The following describes a fifth example of a process in which the CPU 81 determines whether or not the abnormality condition is satisfied. In the fourth example, the cycle condition is the frequency condition, and the amplitude condition is not employed.

In the fifth example, when the detection signal Ls0 satisfies the frequency condition, the CPU 81 determines that the detection signal Ls0 satisfies the abnormality condition.

When the detection signal Ls0 fails to satisfy the frequency condition, the CPU 81 determines that the detection signal Ls0 fails to satisfy the abnormality condition.

As shown above, during the operation of the drive mechanism 65, the CPU 81 executes the abnormality notifying process when the detection signal Ls0 satisfies the abnormality condition, which includes either or both the predetermined amplitude condition and the cycle condition of the rotation cycle Tr0 of the developer bottle 5 (S5).

Furthermore, during the operation of the drive mechanism 65, the CPU 81 executes the full-state notifying process when the detection signal Ls0 fails to satisfy the abnormality condition, and at the same time the position indicated by the detection signal Ls0 is lower than the predetermined reference position (S12).

By employing the image forming apparatus 10, it is possible with a simple mechanism to correctly detect the full-state of the developer bottle 5 and level the accumulation of the developer 9 inside the developer bottle 5.

In addition, when the abnormality notifying process is executed, the CPU 81 stops the drive mechanism 65 (S4). This configuration prevents the abnormal rotation of the developer bottle 5 from causing noise and damage to devices such as the developer bottle 5.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a bottle attaching portion which is supported to be movable in an up-down direction and to which a bottle configured to store powdery developer is removably attached in a state where a longitudinal direction of the bottle is horizontally oriented;

a driving mechanism configured to rotate the bottle attached to the bottle attaching portion by engaging with a first end of the bottle in the longitudinal direction;

a cover member supported in such a way as to be able to open and close an opening of a body of the image forming apparatus from which the bottle is inserted, the cover member being positioned facing a second end of the bottle in the longitudinal direction attached to the bottle attaching portion;

an elastic member configured to apply an upward elastic force to the bottle attaching portion;

a level sensor configured to detect a position of the bottle attaching portion in the up-down direction; and a signal processing device configured to execute an abnormality notifying process when a detection signal of the level sensor during operation of the driving mechanism satisfies an abnormality condition that includes either or both of a predetermined amplitude condition and a cycle condition for a rotation cycle of the bottle, wherein the signal processing device is configured to execute a full-state notifying process when the detection signal during operation of the driving mechanism fails to satisfy the abnormality condition, and a position indicated by the detection signal is lower than a predetermined reference position.

2. The image forming apparatus according to claim 1, wherein the cycle condition includes a frequency condition that a result of a Fourier transform process performed on the detection signal includes a predetermined degree of frequency component that corresponds to the rotation cycle of the bottle.

3. The image forming apparatus according to claim 2, wherein the amplitude condition includes a first peak value condition and a second peak value condition, wherein the first peak value condition is that a peak-to-peak value of the detection signal is higher than a predetermined first threshold, the second peak value condition is that the peak-to-peak value of the detection signal is higher than a second threshold and not higher than the first threshold, and the second threshold is lower than the first threshold, the signal processing device does not execute the Fourier transform process and determines that the detection signal satisfies the abnormality condition when the detection signal satisfies the first peak value condition, and the signal processing device determines that the detection signal satisfies the abnormality condition when the detection signal satisfies the second peak value condition and the frequency condition.

4. The image forming apparatus according to claim 2, wherein the amplitude condition includes a first peak value condition and a second peak value condition, wherein the first peak value condition is that a peak-to-peak value of the detection signal is higher than a predetermined first threshold, a second peak value condition is that the peak-to-peak value of the detection signal is higher than a second threshold and not higher than the first threshold, and the second threshold is lower than the first threshold, the cycle condition further includes a peak interval condition that a peak-to-peak time interval of the detection signal is within a predetermined error range of a half cycle of the rotation of the bottle, the signal processing device does not execute the Fourier transform process and determines that the detection signal satisfies the abnormality condition when the detection signal satisfies the first peak value condition and the peak interval condition, and the signal processing device determines that the detection signal satisfies the abnormality condition when the detection signal satisfies the second peak value condition and the frequency condition.

5. The image forming apparatus according to claim 1, wherein the amplitude condition includes a peak value condition that a peak-to-peak value of the detection signal is higher than a predetermined threshold, and the cycle condition includes a peak interval condition that a peak-to-peak time interval of the detection signal is within a predetermined error range of a half cycle of the rotation of the bottle, and the signal processing device determines that the detection signal satisfies the abnormality condition when the detection signal satisfies both the peak value condition and the peak interval condition.

6. The image forming apparatus according to claim 1, wherein the signal processing device stops the driving mechanism when the abnormality notifying process is executed.

* * * * *